US006924445B2

(12) United States Patent
Bresciani et al.

(10) Patent No.: US 6,924,445 B2
(45) **Date of Patent: *Aug. 2, 2005**

(54) LOW-VOLTAGE CIRCUIT BREAKER

(75) Inventors: Nicola Bresciani, Bergamo (IT); Roberto Rota Martir, Brembate Sopra (IT)

(73) Assignee: ABB Service S.r.l., Milan (IT)

( * ) Notice: Subject to any disclaimer, the term of this patent is extended or adjusted under 35 U.S.C. 154(b) by 0 days.

This patent is subject to a terminal disclaimer.

(21) Appl. No.: 10/494,303

(22) PCT Filed: Oct. 30, 2002

(86) PCT No.: PCT/EP02/12167

§ 371 (c)(1),
(2), (4) Date: May 3, 2004

(87) PCT Pub. No.: WO03/041100

PCT Pub. Date: May 15, 2003

(65) Prior Publication Data

US 2005/0000785 A1 Jan. 6, 2005

(30) Foreign Application Priority Data

Nov. 6, 2001 (IT) ..... MI2001A2327

(51) Int. Cl.[7] ..... H01H 1/22
(52) U.S. Cl. ..... 200/244; 200/400; 335/16
(58) Field of Search ..... 200/244, 400, 200/401, 239, 250; 335/16

(56) References Cited

U.S. PATENT DOCUMENTS 4,910,485 A * 3/1990 Bolongeat-Mobleu et al. ... 335/195
5,534,835 A 7/1996 McColloch et al.
5,539,167 A * 7/1996 Hood et al. ..... 200/244
6,262,642 B1 * 7/2001 Bauer ..... 335/16
6,403,901 B1 * 6/2002 Boeder et al. ..... 200/244

FOREIGN PATENT DOCUMENTS

| | | |
|---|---|---|
| DE | 1137038 U1 | 9/2001 |
| EP | 0 903 763 A2 | 3/1999 |
| EP | 0 903 763 A3 | 6/1999 |
| EP | 1 137 038 A2 | 9/2001 |

* cited by examiner

*Primary Examiner*—Richard K. Lee
(74) *Attorney, Agent, or Firm*—Connolly Bove Lodge & Hutz LLP; Myron K. Wyche

(57) ABSTRACT

A low-voltage circuit breaker, comprising:

at least one first fixed contact, which is electrically connected to a terminal for connection to an electric circuit;

a rotating moving contact, which comprises a central body from which at least one first arm protrudes, an active surface being provided at the end of the first arm, the active surface being associable/separable with respect to the fixed contact by means of a rotation of the moving contact;

a rotating contact supporting shaft, which is functionally connected to an actuation mechanism of the circuit breaker and is provided with a seat that accommodates the central body of the moving contact so that the first arm protrudes externally from the seat, at least one first spring being furthermore arranged in the contact supporting shaft and being functionally coupled to the moving contact and suitable to ensure, when the circuit breaker is closed, an adequate contact pressure between the active surface and the first fixed contact; its particularity consists of the fact that at least one first abutment surface is provided on the central body of the moving contact and is suitable to act, during a rotation of the moving contact caused by a short-circuit, against a complementarily shaped surface formed in the seat of the shaft, so that at least part of the energy accumulated by the rotating moving contact during its rotation is transmitted directly to the shaft.

12 Claims, 3 Drawing Sheets

LOW-VOLTAGE CIRCUIT BREAKER

The present invention relates to a low-voltage circuit breaker, i.e., for applications with operating voltages up to 1000 volts.

BACKGROUND OF THE INVENTION

Low-voltage industrial electrical systems characterized by high currents and power levels normally use specific devices, commonly known in the art as automatic power circuit breakers.

These circuit breakers are designed so as to provide a series of features required to ensure the correct operation of the electrical system in which they are inserted and of the loads connected to it. For example, they ensure the nominal current required for the various users, allow correct insertion and disconnection of the loads with respect to the circuit, protect the loads against abnormal events such as overloading and short-circuits by opening the circuit automatically, and allow to disconnect the protected circuit by galvanic separation or by opening suitable contacts in order to achieve full isolation of the load with respect to the electric power source.

Currently, these circuit breakers are available according to various industrial embodiments, the most common of which entrusts the opening of the contacts to complicated kinematic mechanisms that utilize the mechanical energy stored beforehand in special opening springs and are generally triggered, in case of electrical fault, by an appropriate protection device, typically a relay.

In certain operating conditions, particularly when the presumed short-circuit current can assume significantly high values, the use of devices that utilize in a traditional manner the energy that can be accumulated in the opening springs can be scarcely efficient and uneconomical for opening the contacts; in such cases, one normally resorts to special types of automatic circuit breaker that have technical solutions aimed at increasing their breaking capacity.

Among the technical solutions that are currently most widely used, there are two that are often used in combination. In particular, a first solution forces the current to follow a given path, so that when a short circuit occurs, electrodynamic repulsion forces occur between the contacts. These repulsion forces generate a useful thrust that helps to increase the separation speed of the moving contacts with respect to the fixed contacts; in this manner, the intervention time is reduced and the presumed short-circuit current is prevented from reaching its maximum value.

The second solution doubles the fixed contacts and the moving contacts. In this case, the flow of current is interrupted in each pole of the circuit breaker in two separate regions that are arranged electrically in series to each other, so that each region is subjected to a lower mechanical and thermal stress.

A particularly critical aspect of known types of circuit breaker is the fact that the presence of electrodynamic repulsion forces, while contributing positively to the generation of the thrust useful for contact separation on the one hand, on the other hand helps the moving contact structure to reach the end of its stroke at high speed and therefore with great energy. This generally tends to cause violent impacts against the case of the circuit breaker, with the possibility of damaging it, and can therefore require the use of additional cushioning elements; moreover, bouncing of the moving contacts toward the fixed contacts and undesirable restrikes of the electric arc can occur. In the case of circuit breakers with double contacts, the likelihood of bouncing and restriking of the electric arc can be increased by the presence of additional springs, which are usually associated with the structure of each moving contact in order to facilitate an even distribution of the mechanical pressure on the two surfaces for coupling between each moving contact and the corresponding fixed contacts.

BRIEF SUMMARY OF THE INVENTION

The aim of the present invention is to provide a low-voltage circuit breaker that allows to obviate the drawbacks noted above and in particular in which opening in the short-circuit condition occurs in a manner that is optimized and functionally more effective than in known solutions, at the same time eliminating or at least minimizing the impacts that the moving contact can have against the case of the circuit breaker and the consequent negative effects caused by said impacts.

This aim and other objects that will become more clear hereinafter are achieved by a low-voltage circuit breaker, comprising:

at least one first fixed contact, which is electrically connected to a terminal for connection to an electric circuit;

a rotating moving contact, which comprises a central body from which at least one first arm protrudes, an active surface being provided at the end of said first arm, said active surface being associable/separable with respect to said fixed contact by means of a rotation of said moving contact;

a rotating contact supporting shaft, which is functionally connected to an actuation mechanism of the circuit breaker and is provided with a seat that accommodates the central body of the moving contact so that the first arm protrudes externally from said seat, at least one first spring being furthermore arranged in said contact supporting shaft, said first spring being functionally coupled to the moving contact and being suitable to ensure, when the circuit breaker is closed, an adequate contact pressure between the active surface and the first fixed contact; characterized in that at least one first abutment surface is provided on said central body of the moving contact and is suitable to act, during a rotation of the moving contact caused by a short-circuit, against a complementarily shaped surface formed in said seat of the shaft, so that at least part of the energy accumulated by the rotating moving contact during its rotation is transmitted directly to the shaft.

BRIEF DESCRIPTION OF THE SEVERAL VIEWS OF THE DRAWINGS

Further characteristics and advantages of the invention will become better apparent from the description of preferred but not exclusive embodiments of the circuit breaker according to the invention, illustrated only by way of non-limitative example in the accompanying drawings, wherein.

DETAILED DESCRITION OF THE INVENTION

Figure 1:
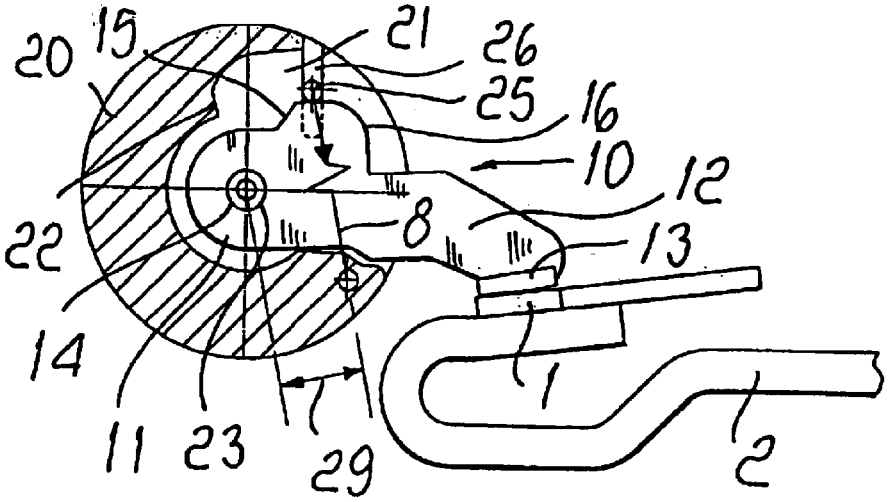
FIG. 1 is a plan view of a first embodiment of the assembly constituted by the contact supporting shaft, the moving contact with a single arm, and a fixed contact, which can be used in the circuit breaker according to the invention.

In the following description, for the sake of greater simplicity in description, reference is made to a single pole of the circuit breaker, without thereby intending to limit in any way the scope of the invention, since the conceived solution can be applied to all the poles of a low-voltage circuit breaker having any number of poles. Moreover, in the various figures identical reference numerals designate identical or technically equivalent elements.

With reference to the cited figures, a pole of the low-voltage circuit breaker according to the invention generally comprises at least one first fixed contact 1, which is connected electrically, by means of an appropriately configured conductor 2, to a terminal for connection to an electric circuit, according to embodiments that are widely known in the art and are therefore not described in detail; the pole furthermore comprises a rotating moving contact 10 and a rotating contact supporting shaft 20, which is shown in cross-section in FIGS. 1 to 4 for the sake of greater clarity of illustration and is functionally connected to the moving contact 10 and to a circuit breaker actuation mechanism 30. As shown in detail in FIG. 5, said actuation mechanism 30 generally comprises a kinematic system with opening springs 31 and allows to connect functionally the contact supporting shaft 20 to a lever for the manual actuation of the circuit breaker 32. The circuit breaker, moreover, is usually provided with a protection device (not shown) for protection against electrical faults, typically a relay, which trips when an electrical fault occurs, causing the actuation of the actuation mechanism 30, with consequent rotation of the contact supporting shaft 20 and release of the circuit breaker. The operation of the protection relay and of the actuation mechanism 30, as well as the corresponding methods for their functional connection to each other and to the other parts of the circuit breaker, are also widely known in the art and therefore are not described further.

As shown in detail in FIGS. 1 to 4, the rotating contact supporting shaft 20 has a seat 21 that is contoured appropriately so as to have at least one interaction surface 22, and a pivot 23 is fixed in the seat 21.

In turn, the rotating moving contact 10 has a contoured central body 11, from which at least one first arm 12 protrudes; an active surface 13, for example a contact plate or pad, is arranged at the end of said arm and can be coupled/separated electrically with respect to the fixed contact 1 following the rotation of said moving contact 10. In particular, in the illustrated embodiments, the moving contact 10 is functionally connected to the shaft 20 and is arranged so that the central part 11 is accommodated in the seat 21, so that the end of the arm 12 protrudes transversely outside it; preferably, the moving contact 10 is connected to the shaft 20 by coupling a hole 14 formed in the central body 11 to the pivot 23, according to a solution that is advantageous from the point of view of manufacture and assembly. Clearly, the functional connection between the shaft 20 and the moving contact 10 might be provided in different manners, for example by providing the pivot on the body of the moving contact and the coupling hole in the shaft, or by providing a floating coupling exclusively by means of one or more springs arranged in the seat 21 and suitably connected to the shaft and to said moving contact, or in other manners, provided that they are compatible with the application.

Advantageously, in the circuit breaker according to the invention, on the contoured central body 11 of the moving contact 10 there is at least one first abutment surface 15, which is suitable to interact functionally against the complementarily shaped surface 22 for the purposes that will become better apparent in detail hereinafter.

Figure 2:
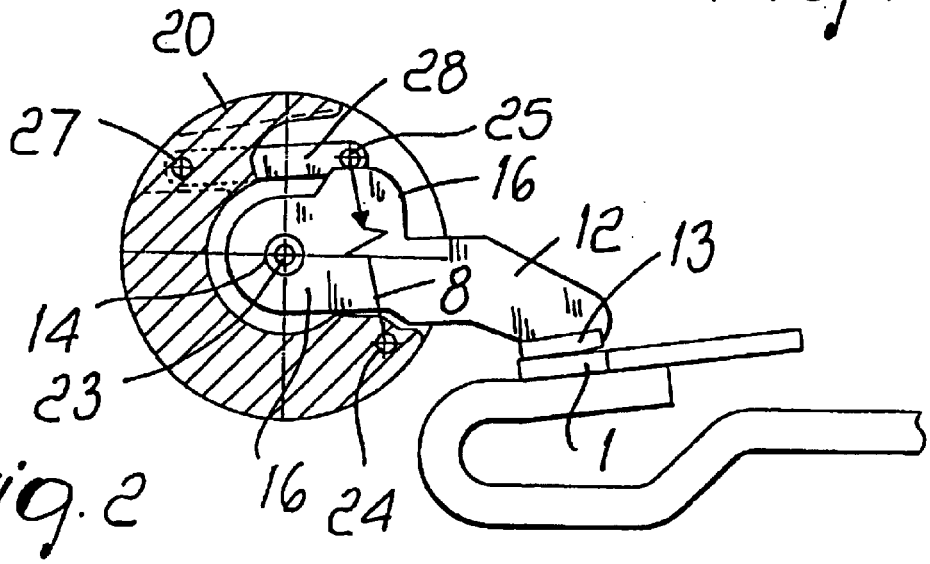
FIG. 2 is a plan view of a second embodiment of the assembly constituted by the contact supporting shaft, the moving contact with a single arm, and a fixed contact, which can be used in the circuit breaker according to the invention.

Preferably, in the embodiments shown in FIGS. 1 and 2, at least one first cam-like surface 16 is furthermore provided on the central body 11 of the moving contact 10 and is contiguous to the abutment surface 15 and arranged between said abutment surface and the extension of the arm 12; furthermore, at least engagement means 24 and an additional pivot 25 are arranged on the shaft 20 on mutually opposite sides with respect to the body of the moving contact 10. In particular, in the embodiment shown in FIGS. 1 and 4, the engagement means 24 preferably comprise a second pivot 24, which is rigidly fixed to the shaft 20, while the third pivot 25 is functionally coupled to the moving contact 10 so that it can move with respect to it and is arranged so that its ends are inserted in slots 26 formed in the contact supporting shaft 20.

The embodiment shown in FIG. 2, instead, uses additional engagement means, which preferably comprise a fourth pivot 27 which, taking as reference the first pivot 23, is fixed to the shaft 20 in a substantially symmetrical position with respect to the second pivot 24; in turn, the third pivot 25 is functionally coupled to the moving contact 10 so that it can move with respect to it and is connected to the fourth pivot 27 by virtue of two linkages 28 (only one of which is shown in FIG. 2), which are arranged in the seat 21 of the shaft 20 along two opposite sides of the moving contact 10 which are substantially parallel to each other.

At least one spring is generally associated with the moving contact 10 and is suitable to ensure, when the circuit breaker is closed, an adequate contact pressure between the active surface 13 and the corresponding fixed contact 1. In particular, the circuit breaker according to the invention preferably uses at least two traction springs 8 (only one of which is visible in FIGS. 1 to 4), each anchored to the second pivot 24 and to the third pivot 25 and arranged on mutually opposite sides with respect to the arm 12 of the moving contact 10.

The operation of the circuit breaker according to the invention is now described with reference, by way of example, to the embodiment shown in FIGS. 1 and 4.

Figure 4:
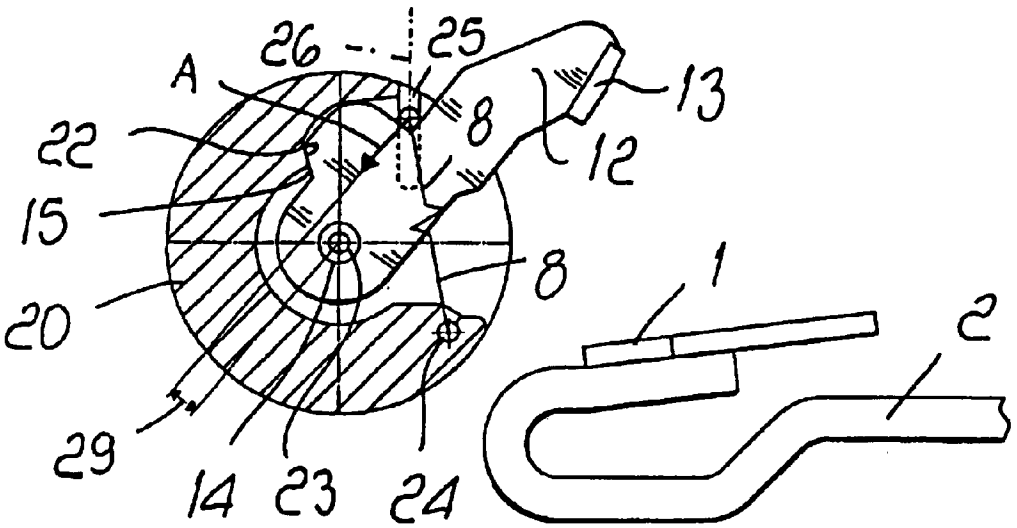
FIG. 4 is a plan view of the moving contact of FIG. 1 during abutment against the contact supporting shaft, during the separation of the active surface from the respective fixed contact following a short circuit.
Figure 5:
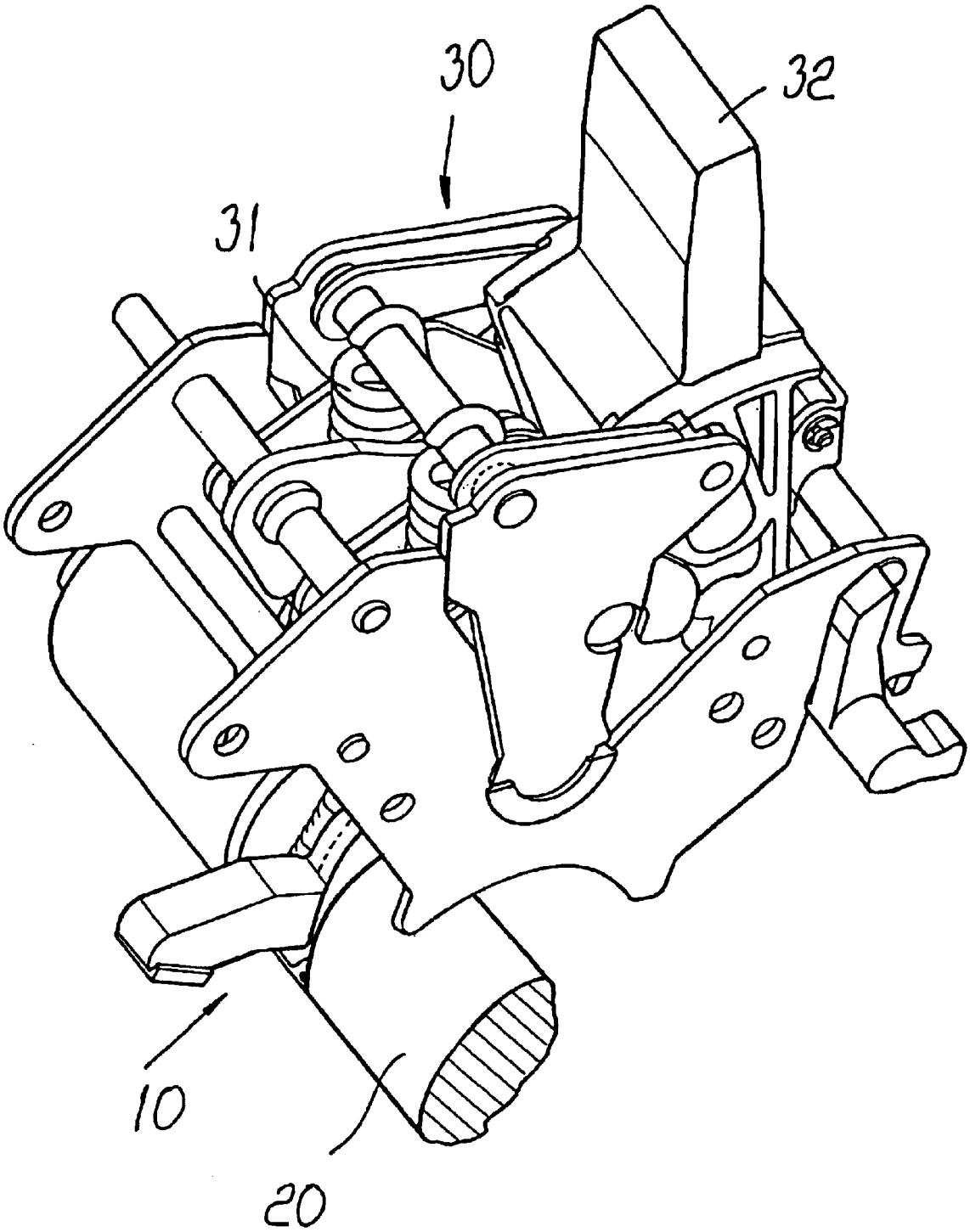
FIG. 5 is a partial perspective view of a contact supporting shaft coupled to a moving contact and to a mechanism for the actuation of the circuit breaker.

In operating conditions, when a short circuit occurs, the electrodynamic repulsion forces generated in the electrical parts crossed by the current trigger the rotation of the moving contact 10, which starting from the position shown in FIG. 1 moves toward the position shown in FIG. 4, in which the abutment surface 15 abuts against the corresponding surface 22; in this situation, owing to the interaction between the surfaces 15 and 22, there is the great advantage that at least part of the kinetic energy possessed by the moving contact 10 during the rotation is transmitted directly to the contact supporting shaft 20 and therefore also distributed among the mechanical parts that are connected thereto.

In a manner that is extremely advantageous and entirely innovative with respect to the known art, the energy transmitted by the moving contact 10 to the shaft 20 is therefore not only removed from the possible impact against the case of the circuit breaker but is actually used to overcome the inertia of said shaft and trigger its rotation prior to the tripping of the protection relay, which in any case acts immediately after the above described effect and causes the release of the actuation mechanism 30 in a fully conventional manner. Therefore, this allows, with respect to known solutions, to perform more rapid opening actions and to reduce the mechanical and electrical stresses that the active parts must withstand in short-circuit conditions, with the beneficial consequence that the behavior of the circuit breaker over its useful life is improved significantly and its useful life is itself extended.

Furthermore, the fact that the energy accumulated by the moving contact during its rotation is utilized to obtain the effect described above prevents all the accumulated kinetic energy from discharging directly onto the case of the circuit breaker, reducing every cause of possible bouncing of the moving contact 10 and therefore of restriking of the electric arc. This positive effect can be increased if the constructive configurations shown in FIGS. 1 and 2 are used. In these cases, the pivot 25, under the action of the corresponding springs associated therewith and of the linkages 28 in the embodiment of FIG. 2, is in fact arranged in abutment against the wall of the cam-like surface 16; this interaction facilitates the generation of a force, indicated by the arrow A, that ultimately produces a moment that tends to keep the active surface 13 of the moving contact 10 coupled to the fixed contact. During opening caused by a short circuit, the rotation of the moving contact 10 entails the sliding of the pivot 25, which under the action of the springs 8 interacts with the cam-like surface 16, remaining in direct contact with it, with relative sliding of the parts in contact; this leads to a variation in the direction of the force A, with a gradual reduction of its lever arm 29 until, as shown in detail in FIG. 4, the interaction between the pivot and the cam-like surface is such as to place the line of action the forces A under center with respect to the pivot 23 and therefore one has a lever arm 29 whose sign is opposite to the initial phase. In this situation, therefore, there is a mechanical moment that matches the direction of rotation of the moving contact 10 that helps to keep the moving contact 10 in the position it has reached, contrasting any bouncing and making it substantially unnecessary to use additional latching systems.

Figure 3:
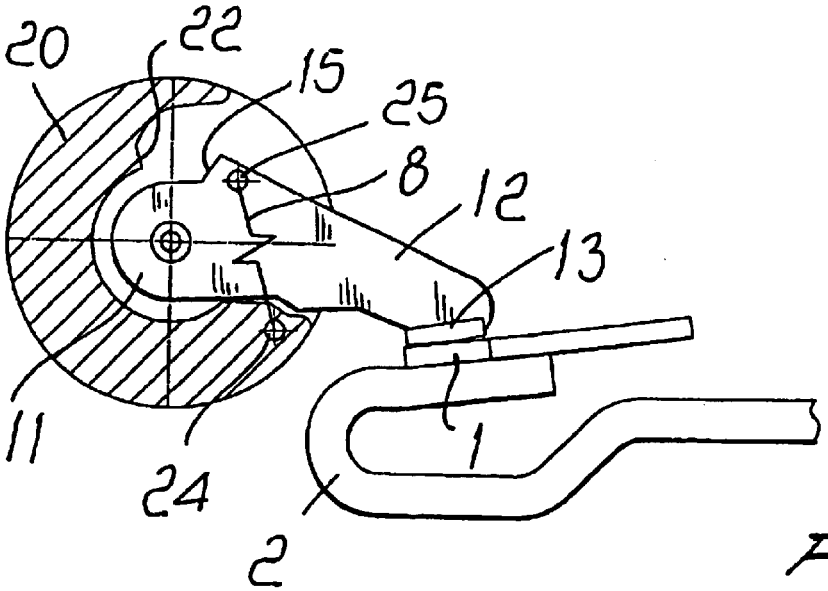
FIG. 3 is a plan view of a third embodiment of the assembly constituted by the contact supporting shaft, the moving contact with a single arm, and a fixed contact, which can be used in the circuit breaker according to the invention.

In any case, it should be noted that the innovative result of the transmission of energy from the moving contact to the rotating shaft requires only the contour of the moving contact to be provided with the abutment surface required to interact with the corresponding surface formed on the shaft and is substantially independent of the type of functional coupling between the shaft and the moving contact and of the contour of the remaining part of said moving contact; for example, in addition to the solutions described above, it would be possible to use a moving contact that is contoured without cam-like surfaces, as shown schematically in FIG. 3, or to connect the moving contact to the shaft by using one or more coupling springs conveniently arranged in the seat without using pivots, or in any other manner so long as it is compatible with the application.

The solutions described above for a single-contact circuit breaker can be implemented easily and just as advantageously in the case of circuit breakers with double contacts; in this case it is in fact substantially sufficient to duplicate, symmetrically with respect to the rotation axis, the shape and the functional parts of the invention.

Figure 6:
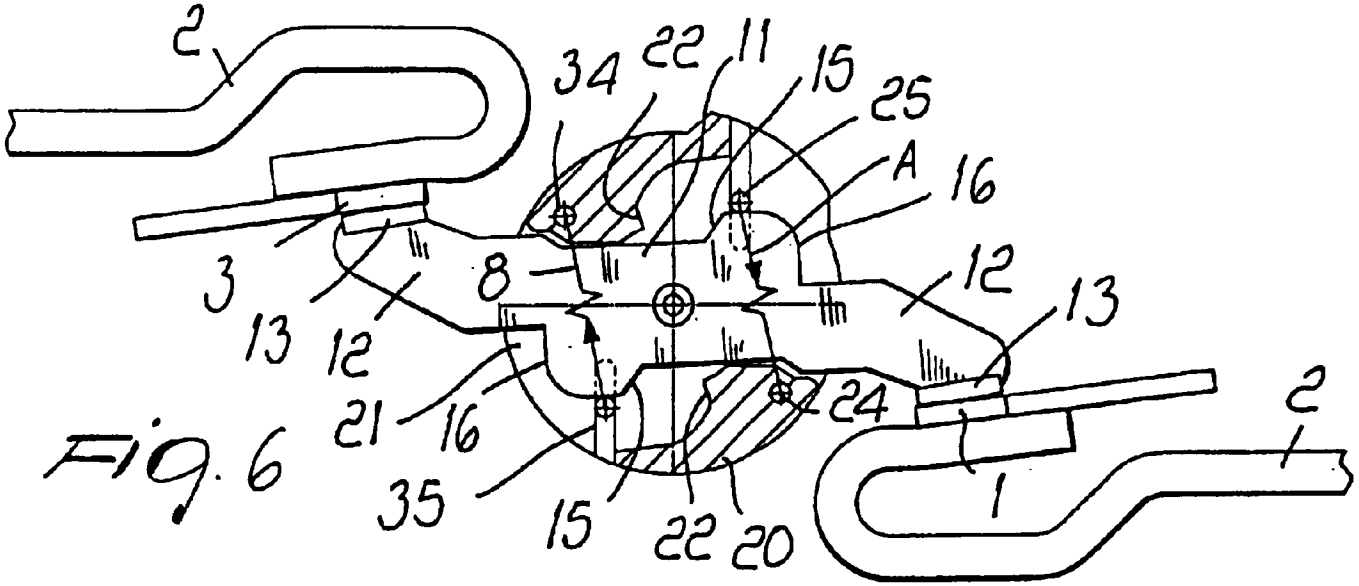
FIG. 6 is a plan view of a possible embodiment of the assembly constituted by the moving contact and the contact supporting shaft, for a circuit breaker with double contacts.

An example in this regard is shown schematically in FIG. 6. As shown in said figure, the circuit breaker is provided with a first fixed contact 1 and with a second fixed contact 3, which are connected electrically, by virtue of appropriately configured conductors 2, to corresponding terminals for connection to an electric circuit. In turn, the rotating moving contact 10 has a contoured central body 11 from which two arms 12 protrude; two active surfaces 13 are arranged at the ends of said arms and in mutually opposite directions with respect to the rotation axis and can be coupled/separated with respect to the corresponding fixed contacts 1 and 3 as a consequence of the rotation of said moving contact 10. Advantageously, in this embodiment, on the contoured central body 11 of the moving contact 10 there are first and second abutment surfaces 15 on mutually opposite sides and substantially symmetrically with respect to the rotation axis and therefore with respect to the bole 14; correspondingly, the seat 21 of the shaft 20 is contoured so as to form two interaction surfaces 22, against each of which an abutment surface 15 acts in a manner that is functionally entirely similar to what has been described for a moving contact with a single arm.

Clearly, even in the case of a circuit breaker with double contacts it is possible to provide the functional connection between the shaft and the moving contact according to various constructive configurations and to adopt or not also the contour with the cam-like surfaces.

For example in the embodiment shown in FIG. 6, on the central body of the moving contact 10 there are two contiguously arranged cam-like surfaces 16, each having a corresponding abutment surface 15; correspondingly, with respect to the solution with single contacts, on the shaft 20 there are also two additional pivots: with reference to the pivot 23, a fourth pivot 34 is fixed to the shaft in a substantially symmetrical position with respect to the second pivot 24, and a fifth pivot 35 is arranged symmetrically with respect to the third pivot 25 and is functionally equivalent thereto. Two additional springs 8 are anchored to the two pivots 34 and 35 and are also arranged on mutually opposite sides with respect to the second arm 12.

Similar modifications can be adopted in passing from a single-contact circuit breaker to a double-contact circuit breaker for the embodiments shown in FIGS. 2 and 3. For example, in the case of FIG. 2 it is sufficient to use a fifth pivot which is arranged, relative to the pivot 23, substantially symmetrically with respect to the pivot 25 and is functionally equivalent thereto; in this case, said fifth pivot 25 can be connected to the second pivot 24 by virtue of an additional pair of linkages 28, and it is possible to use two additional springs 8 that are anchored to the pivot 27 and to said fifth pivot.

It should be noted that in the various embodiments, both with the single-arm moving contact and with the double-arm moving contact, the fixed pivots 24 or 27 or 34 can be replaced in a fully equivalent manner by other engagement means that allow the engagement of the ends of the springs 8 in a manner that is functionally similar to the action of a single fixed pivot: for example, it is possible to use two pivots that are structurally independent of each other and are fixed to the shaft, or two coupling elements coupled to the shaft, or two seats formed therein and suitable to allow the anchoring of the ends of the springs 8, or other means, so long as they are compatible with the application.

In practice it has been found that the circuit breaker according to the invention fully achieves the intended aim, providing a significant series of advantages with respect to the known art and being usable both as a standard circuit breaker and as a current limiter.

The circuit breaker thus conceived is susceptible of numerous modifications and variations, all of which are within the scope of the inventive concept; all the details may furthermore be replaced with other technically equivalent elements. In practice, the materials employed, as well as the dimensions, may be any according to the requirements and the state of the art.

What is claimed is:

1. A low-voltage circuit breaker, comprising:

at least one first fixed contact, which is electrically connected to a terminal for connection to an electric circuit;

a rotating moving contact, which comprises a central body from which at least one first arm protrudes, an active surface being provided at the end of said first arm, said active surface being associable/separable with respect to said fixed contact by means of a rotation of said moving contact;

a rotating contact supporting shaft, which is functionally connected to an actuation mechanism of the circuit breaker and is provided with a seat that accommodates the central body of the moving contact so that the first arm protrudes externally from said seat, at least one first spring being furthermore arranged in said contact supporting shaft, said first spring being functionally coupled to the moving contact and being suitable to ensure, when the circuit breaker is closed, an adequate contact pressure between the active surface and the first fixed contact; characterized in that at least one first abutment surface is provided on said central body of the moving contact and is suitable to act, during a rotation of the moving contact caused by a short-circuit, against a complementarily shaped surface formed in said seat of the shaft, so that at least part of the energy accumulated by the rotating moving contact during its rotation is transmitted directly to the shaft.

2. The circuit breaker according to claim 1, characterized in that said first abutment surface formed on the central body of the moving contact acts against said complementarily shaped surface so as to trigger, in the short-circuit condition, the rotation of the contact supporting shaft before the intervention of said actuation mechanism.

3. The circuit breaker according to claim 2, characterized in that a first pivot is fixed to said contact supporting shaft and is coupled with play in a hole formed in said central body of the moving contact, at least one first cam-like surface being furthermore formed on said central body and being arranged contiguously to said first abutment surface.

4. The circuit breaker according to claim 1, characterized in that a first pivot is fixed to said contact supporting shaft and is coupled with play in a hole formed in said central body of the moving contact, at least one first cam-like surface being furthermore formed on said central body and being arranged contiguously to said first abutment surface.

5. The circuit breaker according to claim 1, characterized in that it comprises at least one second pivot, which is fixed to the shaft, and a third pivot, which is functionally coupled to the moving contact and can slide in slots formed in said shaft, said second and third pivots being arranged on mutually opposite sides with respect to the body of the moving contact, a first spring and a second spring being furthermore anchored to the second and third pivots and being arranged along two opposite sides of the arm of the moving contact, said third pivot interacting functionally with said first cam-like surface so as to generate a mechanical moment that matches the direction of rotation of the moving contact dining at least one final portion of the separation of the active surface from the fixed contact in a short-circuit condition.

6. A The circuit breaker according to claim 5, characterized in that a second cam-like surface is furthermore formed on said central body and is contiguous to said second abutment surface, and in that with reference to said first pivot on said shaft there is also a fourth pivot, which is fixed to the shaft in a substantially symmetrical position with respect to the second pivot, and there is a fifth pivot, which is arranged substantially symmetrically to the third pivot and is coupled functionally to the moving contact and able to slide in slots formed in said shaft, a third spring and a fourth spring being anchored to the fourth end fifth pivots and being arranged along two opposite sides of the moving contact, the fifth pivot interacting functionally with the second cam-like profile so as to generate a mechanical moment that matches the direction of rotation of the moving contact during at least one final portion of the step of separation of the active surfaces from the corresponding fixed contacts in a short-circuit condition.

7. The circuit breaker according to claim 1, characterized in that it comprises at least one second pivot and one third pivot, which are fixed to the shaft in a substantially mutually symmetrical position with respect to said first pivot, and a fourth pivot, which is functionally coupled to the moving contact so that it can move with respect to it, said third and fourth pivots being mutually connected by virtue of a first linkage and a second linkage, which are arranged in said seat of the shaft along two opposite sides of the moving contact, a first spring and a second spring being furthermore anchored to the second and fourth pivots and being arranged along two opposite sides of the rotating moving contact, said fourth pivot interacting functionally with said first cam-like surface so as to generate a mechanical moment that matches the direction of rotation of the moving contact during at least one final portion of the separation of the active surface from the fixed contact in a short-circuit condition.

8. The circuit breaker according to claim 7, characterized in that a second cam-like surface is furthermore formed on said central body and is contiguous to said second abutment surface, and in that it comprises a fifth pivot that is functionally coupled to the moving contact so that it can move with respect to it, said fifth pivot being connected to the second pivot by means of a third linkage and a fourth linkage arranged in said seat of the shaft along two opposite sides of the moving contact, a third spring and a fourth spring being anchored to the fifth and fourth pivots and being arranged along two opposite sides of the moving contact, said fifth pivot interacting functionally with said second cam-like surface so as to generate a mechanical moment that matches the direction of rotation of the moving contact during at least one final portion of the separation of the active surfaces from the fixed contacts in a shaft-circuit condition.

9. The circuit breaker according to claim 13, characterized in that it comprises two fixed contacts that are connected electrically to corresponding terminals for connection to an electric circuit, and in that said rotating moving contact comprises a central body from which a first arm and a second arm protrude, two active surfaces being provided at the ends of said arms and on mutually opposite sides with respect to the rotation axis, said surfaces being associable/separable with respect to said fixed contacts by virtue of the rotation of said moving contact, at least one first abutment surface and one second abutment surface being formed on said central body and being arranged on mutually opposite sides with respect to said rotation axis, said surfaces being suitable to act, during a rotation of the moving contact caused by a short-circuit, against two complementarily shaped surfaces formed in said seat of the shaft.

10. The circuit breaker according to claim 9, characterized in that said first and second abutment surfaces are arranged on the central body of the moving contact and are substantially symmetrical with respect to said rotation axis.

11. The circuit breaker according to claim 9, characterized in that a second cam-like surface is furthermore formed on said central body and is contiguous to said second abutment surface, and in that with reference to said first pivot on said shaft there is also a fourth pivot, which is fixed to the shaft in a substantially symmetrical position with respect to the second pivot, and there is a fifth pivot, which is arranged substantially symmetrically to the third pivot and is coupled functionally to the moving contact and able to slide in slots formed in said shaft, a third spring and a fourth spring being anchored to the fourth and fifth pivots and being arranged along two opposite sides of the moving contact, the fifth pivot interacting functionally with the second cam-like profile so as to generate a mechanical moment that matches the direction of rotation of the moving contact during at least one final portion of the step of separation of the active surfaces from the corresponding fixed contacts in a short-circuit condition.

12. The circuit breaker according to claim 9, characterized in that a second cam-like surface is furthermore formed on said central body and is contiguous to said second abutment surface, and in that it comprises a fifth pivot that is functionally coupled to the moving contact so that it can move with respect to it, said fifth pivot being connected to the second pivot by means of a third linkage and a fourth linkage arranged in said seat of the shaft along two opposite sides of the moving contact, a third spring and a fourth spring being anchored to the fifth and fourth pivots and being arranged along two opposite sides of the moving contact, said fifth pivot interacting functionally with said second cam-like surface so as to generate a mechanical moment that matches the direction of rotation of the moving contact during at least one final portion of the separation of the active surfaces from the fixed contacts in a short-circuit condition.

* * * * *